US009782797B2

(12) United States Patent
Dodds et al.

(10) Patent No.: US 9,782,797 B2
(45) Date of Patent: Oct. 10, 2017

(54) METHOD AND DEVICE FOR PRODUCING A STRUCTURED VARNISH SURFACE

(71) Applicant: Fritz Egger GmbH & Co. OG, Unterradlberg (AT)

(72) Inventors: Royce Dodds, Soest (DE); Andre Wiegelmann, Olsberg (DE)

(73) Assignee: Fritz Egger GmbH & Co. OG, Unterradlberg (AT)

( * ) Notice: Subject to any disclaimer, the term of this patent is extended or adjusted under 35 U.S.C. 154(b) by 144 days.

(21) Appl. No.: 14/395,328

(22) PCT Filed: Mar. 6, 2013

(86) PCT No.: PCT/EP2013/054510
§ 371 (c)(1),
(2) Date: Oct. 17, 2014

(87) PCT Pub. No.: WO2013/156196
PCT Pub. Date: Oct. 24, 2013

(65) Prior Publication Data

US 2015/0064342 A1 Mar. 5, 2015

(30) Foreign Application Priority Data

Apr. 20, 2012 (DE) ..... 10 2012 103 491

(51) Int. Cl.

| | |
|---|---|
| ***B05C 1/00*** | (2006.01) |
| ***B05D 7/08*** | (2006.01) |
| ***B05D 3/04*** | (2006.01) |
| ***B05D 5/02*** | (2006.01) |
| ***B05D 7/00*** | (2006.01) |

(Continued)

(52) U.S. Cl.
CPC ..... *B05D 7/08* (2013.01); *B05C 1/00* (2013.01); *B05D 1/28* (2013.01); *B05D 3/042* (2013.01); *B05D 5/02* (2013.01); *B05D 7/576* (2013.01); *B05D 1/42* (2013.01); *B05D 5/06* (2013.01);

(Continued)

(58) Field of Classification Search
None
See application file for complete search history.

(56) References Cited

U.S. PATENT DOCUMENTS

| | | | | |
|---|---|---|---|---|
| 2,060,801 | A * | 11/1936 | Elchstadt | B41M 3/06 101/154 |
| 2003/0020802 | A1* | 1/2003 | Kreutzkamper | B41C 1/1016 347/264 |
| 2010/0221449 | A1 | 9/2010 | Schlatterbeck et al. | |

FOREIGN PATENT DOCUMENTS

| | | | |
|---|---|---|---|
| DE | 202004018710 | U1 | 4/2005 |
| DE | 202007014736 | U1 | 1/2008 |

(Continued)

*Primary Examiner* — Charles Capozzi
(74) *Attorney, Agent, or Firm* — The Webb Law Firm

(57) ABSTRACT

The invention relates to a method for producing a structured, at least partly optically transparent varnish surface on a surface of a substrate board, preferably of a wood material board, having a decoration. The steps of the method include applying a transparent or at least partly transparent varnish to an applicator roll thereby producing a structured varnish surface and transferring the structured varnish surface to a substrate board having a decoration. The varnish is applied to the applicator roll by a plurality of digitally controlled nozzles in a distribution defining a structure and/or is transformed on the applicator roll into a distribution defining a structure. Furthermore, a device for carrying out the method is described.

18 Claims, 2 Drawing Sheets

(51) Int. Cl.

| | |
|---|---|
| ***B05D 1/28*** | (2006.01) |
| *B05D 5/06* | (2006.01) |
| *B05D 1/42* | (2006.01) |
| *E04F 15/02* | (2006.01) |

(52) U.S. Cl.
CPC ..... *B05D 2203/20* (2013.01); *B05D 2601/26* (2013.01); *E04F 15/02* (2013.01)

(56) References Cited

FOREIGN PATENT DOCUMENTS

| | | | |
|---|---|---|---|
| DE | 102007034877 | A1 | 1/2009 |
| DE | 102009044802 | A1 | 12/2011 |
| DE | 102009004482 | B4 | 3/2012 |
| EP | 2218520 | A2 | 8/2010 |
| EP | 2275261 | A1 | 1/2011 |
| GB | 2322597 | A | 9/1998 |
| WO | 9826936 | A1 | 6/1998 |
| WO | 2006002917 | A2 | 1/2006 |

* cited by examiner

METHOD AND DEVICE FOR PRODUCING A STRUCTURED VARNISH SURFACE

CROSS-REFERENCE TO RELATED APPLICATIONS

This application is the United States national phase of International Application No. PCT/EP2013/054510 filed Mar. 6, 2013, and claims priority to German Patent Application No. 10 2012 103 491.5 filed Apr. 20, 2012, the disclosures of which are hereby incorporated in their entirety by reference.

BACKGROUND OF THE INVENTION

Field of the Invention

The invention relates to a method and to a device for producing a structured, at least partly optically transparent varnish surface on the surface of a substrate board, preferably of a wood material board, which has a decoration.

Description of Related Art

There are various methods for producing floor, wall or ceiling panels and furniture construction panels with decorative surfaces. In addition to methods in which decorative surfaces are produced on wood material boards by coating said boards with printed, resin-impregnated paper (decor paper), methods are also known for printing a decoration, in particular a wood decoration, directly onto wood material boards.

For example, WO 2006/002917 A2 by the Applicant describes a method for producing a wood material board having a decorated surface. In this known method, a surface of the wood material board, which has already been ground and is to be provided with a decoration, in particular with a wood decoration, is primed, then smoothed and subsequently printed directly in the gravure printing method by means of printing rollers (printing cylinders), to produce the decoration.

To produce panels with decorative surfaces, digital printing methods are also used in addition to roller printing methods. Thus for example, WO 98/26936 A1 discloses a method for producing resin-impregnated decor papers for coating substrate boards. In this method, a paper is printed by a digital printer, in particular by a laser printer. The decor paper is pressed onto the substrate board in a hot press, for example in a short-cycle press, the resin which has impregnated the paper being thereby cured. The substrate boards coated with the decor paper (laminates) are intended in particular for furniture construction.

To protect the decoration against abrasive wear, the decor paper or the decoration printed directly onto the substrate board is provided with a transparent sealing layer.

The sealing layer of the decorative surfaces produced thus is usually structured such that it has a three-dimensional surface structure in the end. The three-dimensional structure improves the haptic effect of the decorative surface. The haptic impression produced by the structured decorative surface thereby corresponds to the surface character to be imitated, for example a porous wood surface.

To produce structured surfaces on wood material boards provided with a decoration, structured pressing plates, structured pressing belts or embossing rolls are used in the prior art. Furthermore, structured varnish applicator rolls are also used for this purpose. The production of these plates, belts and rolls is associated with considerable costs. Furthermore, changing said plates, belts and rolls is very time-consuming, which is a disadvantage in the case of a single production plant in which wood material boards are to be produced with different decorations and correspondingly different surface structures.

To solve this problem, it has been proposed to produce the surface structures by directly applying varnish to the board-shaped workpieces by means of digital print heads. In this respect, the print heads operate according to a jet printing method known from ink-jet printers. For this purpose, they are arranged in one or more rows transversely to the feed direction of the workpiece and at a relatively short distance above said workpiece (cf. DE 10 2009 044 802 A1 and EP 2 218 520 A2).

However, a problem which arises during the operation of these known digital applicator devices is the risk of collisions which can occur at the digital print heads when there are unevennesses in the board-shaped workpieces, for example during cupping of the boards and/or if there are foreign bodies on the boards.

SUMMARY OF THE INVENTION

On this basis, the object of the present invention was to provide a method and a device of the type mentioned at the outset, which avoid the above-mentioned disadvantages.

The method according to the invention is characterised in that transparent or at least partly transparent varnish is applied to an applicator roll to produce the structured varnish surface and said applicator roll transfers the varnish to the surface of the substrate board having a decoration, the varnish being applied to the applicator roll in a distribution defining a structure by a plurality of digitally controlled nozzles and/or being transformed on the applicator roll into a distribution defining a structure.

According thereto, the device according to the invention is fitted with an applicator roll for transferring a structured, preferably locally varying varnish surface to the surface of the substrate board having a decoration, the applicator roll being allocated a plurality of digitally controlled nozzles which are configured to apply transparent or at least partly transparent varnish to the applicator roll in a distribution defining a structure and/or are configured to transform on the applicator roll a transparent or at least partly transparent varnish, applied to the applicator roll as a varnish film, in a distribution defining a structure.

Since according to the invention, the nozzles are not arranged at a short distance above the board-shaped workpiece and the structured varnish surface is applied by the applicator roll, the nozzles are protected from collisions which can happen if they are arranged at a short distance above the board-shaped workpiece and the board-shaped workpieces are uneven, for example cupped, or there are foreign bodies on the workpieces.

Whereas when structured embossing rolls in particular are used, the surface structure producible thereby is typically repeated on the board-shaped workpiece, the solution according to the invention basically makes it possible to produce a "continuous", non-repetitive three-dimensional surface structure. The length of a surface structure which does not have repetitions and can be produced by the method according to the invention is restricted in practical terms only by the maximum length of the board-shaped workpiece.

Furthermore, the present invention allows the use of a smooth, standard applicator roll, i.e. an applicator roll which has a smooth or slightly structured lateral surface, typically a regularly structured lateral surface. A smooth standard applicator roll of this type is considerably cheaper than a structured pressing plate or an engraved varnish applicator roll.

A preferred configuration of the invention provides that the varnish is applied to the applicator roll in such a distribution and/or is transformed on the applicator roll into such a distribution that the structure, resulting from this distribution, of the structured varnish surface produced on the surface of the substrate board defines pores which match the decor image of the decoration. In this manner, a three-dimensional surface structure which is adapted to the decoration, for example a wood, tile or natural stone decoration, is produced on the board-shaped workpiece.

A further preferred configuration of the invention provides that before the varnish is transferred to the substrate board, the decor image of the decoration or a guide mark placed on the substrate board is detected by an optical scanning device and measuring signals generated by the scanning device are used to control the digitally controlled nozzles. In this manner, the three-dimensional surface structure can be automatically adapted to the decor image, particularly even when the decor image itself changes according to a random principle. For example, the decoration, preferably a wood decoration, can be printed according to the invention by a printer device having digital print heads, in particular ink-jet print heads, the print heads being controlled by a computer or the like such that the decor image in its entirety or at least a region of the decor image varies according to a random principle.

A further advantageous configuration of the invention is characterised in that the digitally controlled nozzles which are used are digitally controlled gas nozzles, preferably compressed air nozzles. By means of such gas nozzles or compressed air nozzles a film of at least partly transparent varnish, applied to the applicator roll, can be transformed into a distribution defining a three-dimensional structure. In this respect, regions in the varnish film are displaced by jets of gas or compressed air, thereby producing a three-dimensional structure. For this purpose, a plurality of gas or compressed air nozzles are preferably arranged in a plurality of rows along the axis of the applicator roll and are controllable independently of one another. The nozzles of adjacent rows are preferably arranged axially offset to one another. In any case, the gas jets or air jets, generated by the nozzles, are thereby able to act on the applicator roll or on a film of varnish applied thereto in a switchable pattern.

The variant of the solution according to the invention, in which a film of at least partly transparent varnish applied to the applicator roll is transformed into a distribution, defining a three-dimensional structure, by digitally controlled gas- or compressed air nozzles or jets of gas or compressed air, has several advantages over digital print heads which operate according to the ink-jet printing method. A significant advantage is in particular that gas or compressed air nozzles are not susceptible to wear or are hardly subject to wear compared to varnish jet print heads and are thus very easy to maintain. In contrast, varnish jet print heads are at great risk of becoming blocked. The susceptibility to wear thereof is also relatively high. The specific local displacement of a film of varnish applied to the applicator roll by gas- or compressed air nozzles according to the solution variant of the invention allows the addition of particles which increase abrasion resistance in the varnish used to produce the three-dimensional surface structure. Accordingly, a preferred configuration of the invention provides that the varnish contains hard particles, preferably corundum particles. However, in the case of varnish jet print heads, it is virtually impossible to use a varnish containing hard particles due to the print head wear and to the risk of blockage increased thereby. Furthermore, digital gas or compressed air nozzles suitable for the solution variant according to the invention are much more cheaply available than digital varnish jet print heads.

Furthermore, tests have shown that the solution variant according to the invention and characterised by the use of digital gas or compressed air nozzles allows significantly higher print speeds than the variant using only conventional varnish jet print heads.

A further advantageous configuration of the invention is characterised in that the varnish applied to the applicator roll is pre-dried or pre-cured thereon or in that associated with the applicator roll is a radiation source or a heating device, which is configured to pre-dry or pre-cure on the applicator roll the varnish which has been applied thereto. This counteracts a run (flow) of the three-dimensional varnish structure produced on the applicator roll, as a result of which the resolution (definition) of the structured varnish surface produced on the board-shaped workpiece can be improved.

A further preferred configuration of the invention provides that the applicator roll is rubberised and/or bowed. This configuration also plays a part in improving the resolution of the structured varnish surface produced on the board-shaped workpieces. An applicator roll sleeve consisting of rubber or of a rubber-like material counteracts a flow of the varnish structure produced on the applicator roll and can compensate for unevennesses in the board-shaped workpiece to be printed. A bowed configuration of the applicator roll furthers the achievement of a uniform vertical distribution of the varnish structure over the width of the applicator roll.

In the following, the invention will be described in more detail with reference to schematic drawings illustrating different embodiments.

DESCRIPTION OF THE INVENTION

Figure 1:
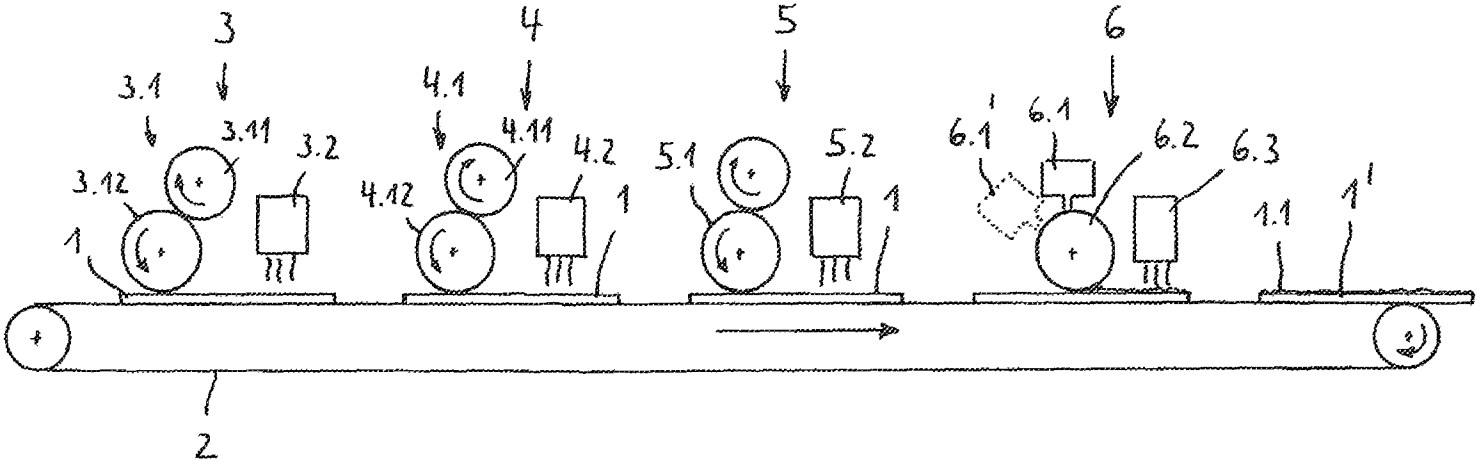
FIG. 1 is a side view of a device or installation having a plurality of print stations for producing board-shaped products having a decorated surface.

FIG. 1 shows a device or installation for producing board-shaped products, for example furniture construction boards or floor, wall or ceiling panels, having a decorated surface.

A plurality of board-shaped workpieces 1 are arranged on a conveyor belt 2 and are individually fed successively to various processing stations 3, 4, 5 and 6. The feed direction of the workpieces 2 is indicated by an arrow and runs from left to right. Instead of a plurality of single workpieces 1, one large-area workpiece or a continuously produced workpiece can also be processed, which is divided into individual boards (blanks) after being processed as described in the following. The conveyor belt speed or feed rate of the workpieces 1 is, for example, within a range of from 1 to 120 m/min.

The board-shaped workpiece 1 acts as a substrate and can therefore also be called a substrate board.

The workpiece or substrate board 1 is produced from wood material, from laminate and/or from at least one compact board. Compact boards are produced from resin-impregnated cellulose webs which are pressed in laminate presses under high pressure and at elevated temperatures. However, the substrate boards 1 are preferably ground wood material boards, for example chipboard, medium-density fibreboard (MDF), high-density fibreboard (HDF) or hardboard.

After an optional brushing station (not shown) which removes impurities or grinding dust which may be present, fillers are applied in several stages, preferably by applicator rolls (not shown), an intermediate drying procedure being carried out after each stage. A primer coat kept in the basic colour of a subsequently printed-on decoration is then applied, again in several stages, to the thus present substrate board 1 by rolls (not shown) and here again a partial drying is carried out after each application.

The primed substrate board 1 is then preferably smoothed. This is performed, for example, using heated polished steel rolls (not shown) which are operated over the width of the substrate board 1 and pressed against said substrate board 1 at a peripheral rotational speed greater than or less than the feed rate of the substrate boards 1. Thereafter, the substrate board 1 processed thus exhibits over its entire upper side a surface which is even and uniform in colour, gloss level and structure.

Directly following the optional smoothing device (not shown), a decoration (decor image), for example a wood, natural stone or tile decoration, is printed onto the substrate board 1. The decor image is preferably printed onto said board 1 by one or more print roll assemblies 3.1, 4.1. The respective print roll assembly 3.1, 4.1 is typically constructed from an engraved print roll (print cylinder) 3.11, 4.11 with inking and dampening rolls and a blanket cylinder 3.12, 4.12 with a counter-pressure cylinder. This printing method is also known as indirect gravure printing.

Instead of one or more print roll assemblies 3.1, 4.1, according to the invention it is also possible to use a digital printer device (not shown), in particular an ink-jet printer device, to print a desired decor image onto the substrate boards 1. The digital printer device is preferably controlled such that the decor image is varied so that no substrate boards 1 or practically no substrate boards 1 are produced with identical decor images. For this purpose, the digital printer device is connected, for example, to a computer which varies the size, shape and/or position of one or more decor image elements, for example the image of a wood grain, of heartwood and sapwood, of a knot (knot cross section), resin galls, burrs, age rings, burrows (for example woodworm holes/passages), nail heads, screw heads, etc, according to the random principle and controls the digital print heads of the printer device accordingly.

Post-processing devices 3.2, 4.2 are arranged downstream of the digital printer device or print roll assemblies 3.1, 4.1. The respective post-processing device 3.2, 4.2 can carry out a drying or partial drying of the printed decor image, for example by a stream of hot air or by high-energy and/or electromagnetic radiation, in particular UV radiation.

Following the digital printer device or print roll assembly 4.1 or the post-processing device 4.2 is optionally at least one processing station 5 which applies a sealing layer (wear-protection layer) to the decoration.

A transparent UV-curable varnish coating is preferably applied in at least two stages as the sealing of the decoration. The sealing varnish can contain corundum particles and/or other particles which increase the wear resistance. If the decorative boards 1 to be produced are boards which are not exposed to a high abrasive stress, for example furniture parts, particularly back walls of cupboards, then the sealing varnish can also be free from corundum particles or other particles which increase wear resistance. Alternatively or in addition to wear-resistance-increasing particles, the sealing varnish can contain further additives, for example scratch-resistance-increasing additives and/or antistatic agents.

In processing station 5, a substantially full-surface coating of a UV-curable, transparent sealing varnish is applied. For this purpose, processing station 5 has an applicator roll 5.1 which applies a uniform layer of varnish to the upper side of the substrate board 1 printed with the decoration. The applied coating is at least partly dried and cured in the post-processing device 5.2 connected downstream.

In a further processing station 6, an at least partly optically transparent, three-dimensionally structured layer of varnish 1.1 is applied to the surface, having the decoration, of the substrate board 1, the decor image of which has preferably been coated with a transparent sealing layer. According to the invention, this is performed indirectly by a plurality of digitally controlled nozzles 6.1 combined with an applicator roll 6.2. The varnish used for this purpose is preferably a UV-curable varnish.

By means of a post-processing device 6.3, following applicator roll 6.2, then the last applied varnish layer 1.1 is at least partly cured, so that the three-dimensional structure is fixed. Reference numeral 1' denotes the ready coated substrate board. Processing station 6 for producing the structured, at least partly optically transparent varnish surface 1.1 can be realised in different embodiments.

Figure 2:
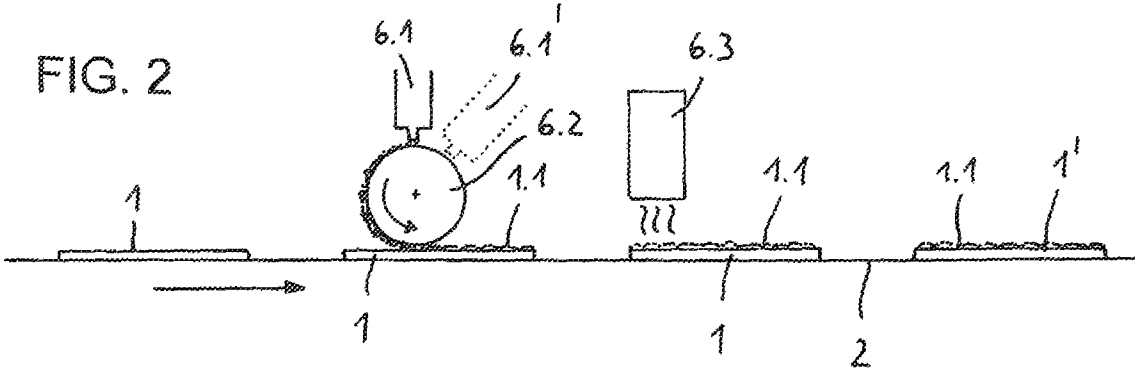
FIG. 2 shows a first embodiment of an applicator device according to the invention.

In the embodiment shown in FIG. 2, a plurality of digitally controlled nozzles 6.1 as print heads (varnish jet nozzles) is associated with applicator roll 6.2. The nozzles or print heads 6.1 are arranged in at least one row and preferably cover the entire roll width (axial roll length). Depending on the desired print speed, a plurality of rows of print heads can also be provided, which is indicated in FIGS. 1 and 2 by a dotted row of print heads. In this respect, the print heads 6.1 of one row are preferably arranged offset to the print heads 6.1' of the row of print heads running parallel thereto, i.e. they are arranged in the gaps between the print heads of the parallel row of print heads. The print heads 6.1, 6.1' are positioned at a short distance above the applicator roll 6.2, whereas the applicator roll 6.2 delivers the printed-on structure varnish to the substrate board 1 by contact therewith. The lateral surface of applicator roll 6.2 is substantially smooth or slightly structured. Furthermore, applicator roll 6.2 is preferably rubberised and bowed. The bowing, i.e. the specifically barrel-shaped bulge of applicator roll 6.2 towards the centre thereof, compensates the deflection of roll 6.2 which, in the case of a purely cylindrically shaped roll, would result in an application thickness which would not be uniform over the width.

Analogously to the indirect gravure printing of the decor image, the three-dimensional structure is thus not printed directly onto the substrate board 1, but is printed digitally onto applicator roll 6.2 which then transfers the printed-on structure to substrate board 1.

The digital control commands for producing the structure and matching the decor image can be provided in a data record or are calculated or generated using the decor image read in by an optical scanning device (not shown). For this purpose, the decor image is localised on the substrate board 1, for example by a camera system (not shown), and the zero point is calculated or determined for printing the sleeve of the applicator roll 6.2. In this way, it can be ensured that the three-dimensional varnish surface 1.1 with its varnish pores present therein, which is produced, matches the decor image, for example a wood decor image, on substrate board 1. Specialists also call this a "synchronous varnish pore" or a "synchronous surface structure".

Figure 3:
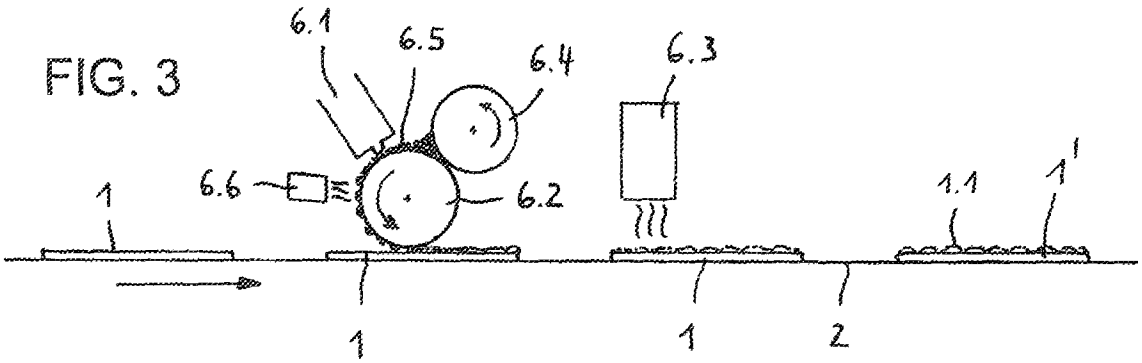
FIG. 3 shows a second embodiment of an applicator device according to the invention.

FIG. 3 is a sketch of a second embodiment of the device according to the invention. In this embodiment, the varnish for producing the surface structure is not applied to applicator roll 6.2 by varnish jet print heads (varnish jet nozzles), but by a metering roll 6.4 and/or by a doctor (not shown). The metering roll 6.4 or doctor produces a film of varnish 6.5 of a defined layer thickness on applicator roll 6.2.

The varnish film 6.5 is then partly displaced on applicator roll 6.2 by streams of gas, preferably by streams of compressed air, and is thereby transformed into a three-dimensional structure. For this purpose, digitally controlled gas nozzles or compressed air nozzles 6.1 are arranged above and/or at applicator roll 6.2. The nozzles 6.1 are arranged in at least one row which extends over the roll width, i.e. along the rotational axis of the applicator roll. A plurality of rows of nozzles is preferably provided (cf. FIG. 1; 6.1, 6.1'), which define a digitally switchable nozzle pattern.

Here again, the lateral surface region of applicator roll 6.2 receiving the varnish is substantially smooth or slightly structured. The applicator roll is also preferably rubberised and/or bowed.

Arranged upstream of applicator roll 6.2 in the feed direction of the substrate board 1 is an optical scanning device (not shown) which detects the decor image or a guide mark placed on the substrate board 1. The scanning device is connected to a control device (not shown) which digitally controls the nozzles 6.1, 6.1', subject to the measuring signals generated by the scanning device.

The applicator roll 6.2 can be allocated a radiation source or a heating device 6.6, which is configured to pre-dry or pre-cure the varnish, applied and structured on the applicator roll 6.2, on said applicator roll 6.2.

The realisation of the invention is not restricted to the above-described embodiments. In fact, numerous variants are possible, which use the invention set out in the accompanying claims, even in a fundamentally different form. Thus for example, it also lies within the scope of the invention to realise the application of the decoration (decor image) to the substrate board 1 by pressing on resin-impregnated decor paper. In particular, it lies within the scope of the invention to combine different features of the described embodiments with one another.

The invention claimed is:

1. A method for producing a structured, at least partly optically transparent varnish surface on a surface of a substrate board comprising the steps of:

applying a transparent or at least partly transparent varnish as a film of varnish to an applicator roll, transforming the film of varnish on the applicator roll, by a plurality of digitally controlled nozzles, into a distribution defining a three dimensional structure, and transferring the structured varnished surface by the applicator roll to the substrate board having a decoration.

2. The method according to claim 1, wherein the varnish is transformed into such a distribution on the applicator roll that the structure resulting from the distribution of the structured varnish surface produced on the surface of the substrate board defines pores which match a decor image of the decoration.

3. The method according to claim 1, wherein before the varnish is transferred to the substrate board a decor image of the decoration or a guide mark placed on the substrate board is detected by an optical scanner, and measuring signals generated by the optical scanner are used to control the digitally controlled nozzles.

4. The method according to claim 1, wherein the varnish applied to the applicator roll is pre-dried or pre-cured on the applicator roll.

5. The method according to claim 1, wherein the varnish is applied as the film of varnish to the applicator roll by a metering roll and/or by a doctor.

6. The method according to claim 1, wherein the applicator roll comprises a substantially smooth applicator roll varnish-receiving lateral surface region.

7. The method according to claim 1, wherein the applicator roll is a rubberised and/or bowed applicator roll.

8. The method according to claim 1, wherein the varnish contains hard particles.

9. A device for producing a structured, at least partly optically transparent varnish surface on a surface of a substrate board, comprising:

an applicator roll for transferring a structured varnish surface to a surface of a substrate board having a decoration;

and a plurality of digitally controlled nozzles wherein the nozzles are configured to transform on the applicator roll a transparent or at least partly transparent varnish, which has been applied to the applicator roll as a film of varnish, into a distribution defining a three-dimensional structure.

10. The device according to claim 9, wherein the digitally controlled nozzles are arranged in at least one row along the rotational axis of the applicator roll.

11. The device according to claim 9 wherein the device further comprises an optical scanner, wherein the optical scanner is arranged upstream of the applicator roll in a feed direction of the substrate board to detect a decor image of the decoration or a guide mark placed on the substrate board, wherein the optical scanner is connected to a controller, and wherein the controller digitally controls the nozzles, subject to the measuring signals generated by the scanner.

12. The device according to claim 9, wherein the digitally controlled nozzles are formed as gas nozzles.

13. The device according to claim 9, further comprising a radiation emitter or a heater, wherein the radiation emitter or the heater is associated with the applicator roll and configured to pre-dry or pre-cure the varnish applied and structured on the applicator roll.

14. The device according to claim 9, wherein a metering roll and/or a doctor, are associated with the applicator roll to produce the film of varnish on the applicator roll.

15. The device according to claim 9, wherein the applicator roll comprises a substantially smooth varnish-receiving lateral surface region.

16. The device according to claim 9, wherein the applicator roll is rubberised and/or bowed.

17. The method according to claim 1, wherein the digitally controlled nozzles are formed as digitally controlled gas nozzles.

18. A device for producing a structured, at least partly optically transparent varnish surface on a surface of a substrate board, comprising:

an applicator roll for transferring a structured varnish surface to a surface of a substrate board having a decoration;

and a plurality of digitally controlled nozzles wherein the nozzles are configured to transform on the applicator roll a transparent or at least partly transparent varnish, which has been applied to the applicator roll as a film of varnish, into a distribution defining a structure, wherein the device further comprises an optical scanner, wherein the optical scanner is arranged upstream of the applicator roll in a feed direction of the substrate board to detect a decor image of the decoration or a guide mark placed on the substrate board, wherein the optical scanner is connected to a controller, and wherein the controller digitally controls the nozzles, subject to the measuring signals generated by the scanner.

* * * * *